US005787905A

United States Patent [19]

Yasuda

[11] Patent Number: 5,787,905

[45] Date of Patent: Aug. 4, 1998

[54] HAIR CLIP

[75] Inventor: Masahiro Yasuda, Higashiosaka, Japan

[73] Assignee: Kabushiki Kaisha Yasuda Corporation, Osaka, Japan

[21] Appl. No.: 899,303

[22] Filed: Jul. 24, 1997

[30] Foreign Application Priority Data

Apr. 7, 1997 [JP] Japan ..... 9-088421

[51] Int. Cl.[6] ..... A45D 8/20

[52] U.S. Cl. ..... 132/277; 24/334; 132/279

[58] Field of Search ..... 132/279, 273, 132/275, 276, 277, 278, 132; D28/32, 39, 40, 41, 42, 43; 24/332, 334, 500, DIG. 29, DIG. 22

[56] References Cited

U.S. PATENT DOCUMENTS

| | | | |
|---|---|---|---|
| D. 380,864 | 7/1997 | Deakin et al. | D28/40 |
| 721,313 | 2/1903 | Lawless | 132/277 |
| 918,203 | 4/1909 | Schwarzer | 132/132 |
| 2,902,042 | 9/1959 | Halber | 132/279 |
| 4,508,124 | 4/1985 | Franzino | 132/277 |
| 5,494,060 | 2/1996 | Potut | 132/279 |
| 5,501,239 | 3/1996 | Walker | 132/275 |
| 5,522,407 | 6/1996 | Kelsey | 132/277 |
| 5,549,127 | 8/1996 | Chang | 132/277 |
| 5,642,740 | 7/1997 | Chen | 132/132 |
| 5,699,814 | 12/1997 | Potut | 132/273 |

FOREIGN PATENT DOCUMENTS

| | | | |
|---|---|---|---|
| 516564 | 12/1992 | European Pat. Off. | 132/276 |
| 270307 | 2/1996 | Taiwan . | |

*Primary Examiner*—Gene Mancene
*Assistant Examiner*—Eduardo C. Robert
*Attorney, Agent, or Firm*—Armstrong, Westerman, Hattori, McLeland & Naughton

[57] ABSTRACT

A hair clip includes a pair of hair retaining members pivoted by a hinge portion and urged toward their closed position by a coil spring wound around a shaft. Each of the hair retaining members includes a comb-like hair retaining portion extending in one direction of the width of the hair retaining member, an outwardly curved lever portion extending in the opposite direction to the comb-like retaining portion and an inwardly protruded comb-like covering portion. The comb-like covering portions are engaged with each other when the comb-like hair retaining portions are in their closed position and are further engaged to cover the coil spring when the lever portions are pinched to approach one another against the spring force of the coil spring.

8 Claims, 5 Drawing Sheets

HAIR CLIP

FIELD OF THE INVENTION

This invention relates to a hair clip and more particularly to a hair clip for retaining bunched hairs by and between a pair of comb-like hair retaining members pivoted together by a hinge portion.

BACKGROUND OF THE INVENTION

Generally, this kind of hair clip comprises a pair of hair retaining members each having a comb-like hair retaining portion extending in one direction of the width of the hair retaining member and a lever portion extending in the opposite direction to the comb-like hair retaining portion. These hair retaining members are pivoted together by a hinge portion. The hinge portion includes a shaft and a coil spring wound around the shaft. The hair retaining members are urged toward an engaging position of the comb-like hair retaining portions by the coil spring. By pinching the lever portions with one's fingers to make them approach one another, the comb-like hair retaining portions, which are engaged with each other when the hair clip is not in use, move to an open position. The hair clip retains bunched hairs by and between the pair of the hair retaining members by placing the opened comb-like hair retaining portions on a bunch of hairs and then releasing the lever portions.

However, this kind of conventional hair clip inherently has a bad appearance and has an inferior design function since the coil spring wound around the shaft is seen when the hair clip is in use.

Further, the coil spring is provided around the shaft under the condition that the coil spring is twisted in a direction to increase the spring force with the straight ends of the coil spring abutting against corresponding inner surfaces of the hair retaining members to close the comb-like hair retaining portions by the spring force. The abutting positions of the straight ends of the coil spring are located at the opposite sides of the longitudinal central portion of the hair retaining members. Therefore, the spring force of the coil spring displaces the positions of the hair retaining members and thus causes the hinge portions of the hair retaining members to twist. As a result, since the hinge portions is easy to break, durability of this kind of hair clip is poor.

SUMMARY OF THE INVENTION

An object of the present invention which was made to resolve the aforementioned problems is therefore to provide a hair clip which comprises a pair of hair retaining members having comb-like hair retaining portions pivoted around a hinge portion including a shaft and a coil spring wound thereon and urged toward a closed position, and which is superior in ornamental performance and has a high durability.

According to the present invention, a hair clip comprises a pair of hair retaining members of molded hard plastic. Each hair retaining member includes a comb-like hair retaining portion extending in one direction of the width of the hair retaining member, an outwardly curved lever portion extending in the opposite direction to the comb-like retaining portion and an inwardly protruded comb-like covering portion. The hair retaining members are hinged by a hinge portion formed between the comb-like hair retaining portion and the comb-like covering portion such that the hair retaining members are swung between a closed position in which the comb-like hair retaining portions are engaged with each other and an opened position in which the comb-like hair retaining portions are disengaged and apart from each other. The hinge portion includes a shaft and a coil spring. The coil spring has end portions which abut and are pressed against the corresponding hair retaining member to urge the comb-like hair retaining portions toward their closed positions. The comb-like covering portions are engaged with each other when the comb-like hair retaining portions are in their closed positions and are further engaged to cover the coil spring when the lever portions are pinched and approach one another against the spring force of the coil spring.

The operation of the hair clip is described as follows. First, the comb-like hair retaining portions are opened by pinching the lever portions with one's fingers to make them approach one another. Next, the opened comb-like hair retaining portions are placed on a bunch of hairs. Then, the lever portions are released. As a result, the comb-like hair retaining portions will retain the bunched hairs. In this state of retaining the bunched hairs, the coil spring of the hinge portion is covered by the deeply engaged comb-like covering portions. Thus, the comb-like covering portions function as ornamental portions. Though the spring force of the coil spring functions to displace the positions of the hair retaining members in the opposite directions, the twisting force is dispersed or received by the engaged comb-like covering portions. Therefore, the durability of the hair clip is enhanced.

If the comb-like covering portions of the hair retaining members are disengaged when the hair clip is not in use, the above-mentioned twisting force which displaces the hair retaining members can cause abutment of the opposite leading edges of both the comb-like hair retaining portions when an user tries to open the hair retaining portions by pinching the lever portions.

It is preferable that the comb-like covering portions are, at their tip portions, engaged with each other when the hair clip is in a closed position so that the comb-like covering portions can be further engaged to widely open the comb-like hair retaining portions.

The comb-like covering portions preferably have a plurality of straight comb-like teeth extending parallel with each other. Further, the comb-like covering portions preferably form an upwardly bent plane with a vertex at the engaged leading edges of the comb-like teeth when the comb-like hair retaining portions are in their closed positions and form a flat or downwardly bent plane when the comb-like hair retaining portions are in their opened positions. Such comb-like covering portions will enhance the appearance because the leading edges of the comb-like covering portions do not protrude outwardly when the hair clip is in use.

The comb-like hair retaining portions are each preferably formed to be inwardly curved so that the pair of the comb-like hair retaining portions can easily and firmly retain a large amount of bunched hair.

Each comb-like hair retaining portion preferably has a plurality of protrusions formed on the inside thereof at regular intervals so that the protrusions can function as anchors in the hairs to firmly retain the hairs when the hair clip is in use.

The comb-like hair retaining portions are preferably formed such that gaps are formed between adjacent comb-like teeth when the hair retaining portions are engaged so that hairs can be inserted in the gaps to enhance the retaining force of the hair clip.

It is preferable that the hinge portion includes a pair of hinge ledges apart from each other and protruding from the insides of the hair retaining members, the corresponding hinge ledges of the hair retaining members being placed adjacent one another, a shaft whose opposite end portions penetrate the corresponding hinge ledges and a locking portion provided with the hinge ledges for restricting further closing rotation of the comb-like hair retaining portions beyond a certain angle therebetween. The hair retaining member preferably further includes a pair of outwardly curved ornamental portions located beside the lever portions so that the ornamental portions can enhance the appearance of the hair clip.

Other objects and advantages of the present invention will become apparent from the description of the preferred embodiments, which may be modified in any manner without departing from the scope and spirit of the invention.

DETAILED DESCRIPTION OF THE PREFERRED EMBODIMENTS

Preferred embodiments of a hair clip, according to the present invention, will now be described in details, with reference to the accompanying drawings.

Figure 1:
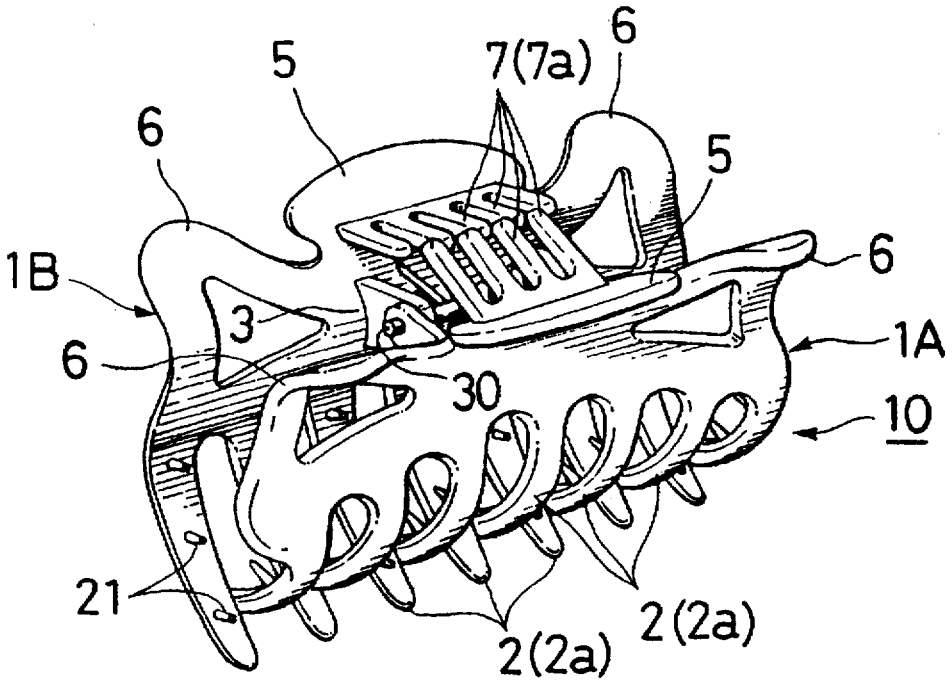
FIG. 1 shows a perspective view of a hair clip of an embodiment according to the present invention.
Figure 2:
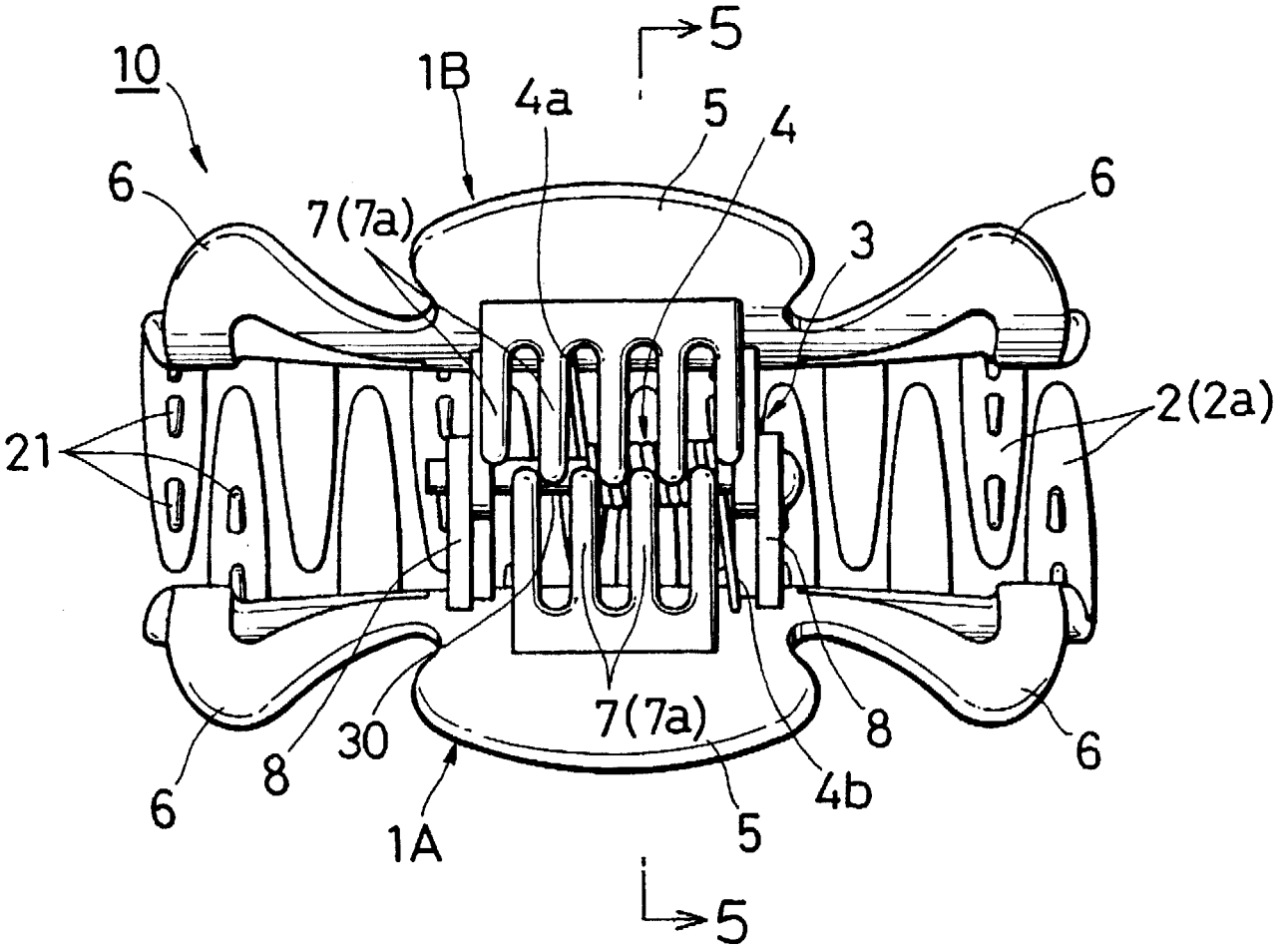
FIG. 2 shows an enlarged top view of the hair clip.
Figure 5:
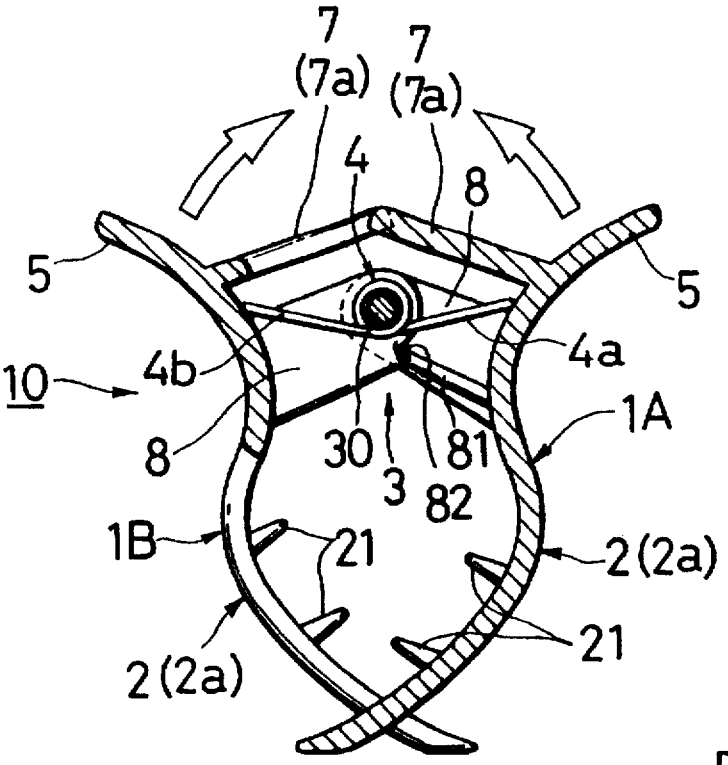
FIG. 5 shows a cross-sectional view of the hair clip in a closed state, taken along the line 5—5 in FIG. 2.
Figure 6:
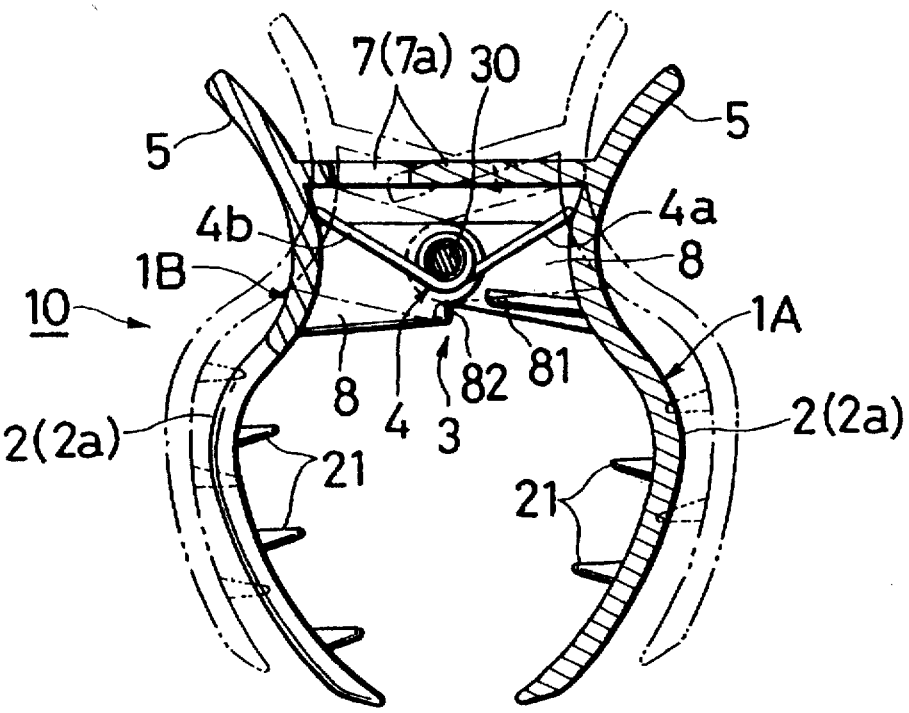
FIG. 6 shows a cross-sectional view of the hair clip in an open state, corresponding to FIG. 5.

As shown in FIGS. 1 and 2, the hair clip 10 includes a pair of hair retaining members 1A, 1B each having a comb-like hair retaining portion 2 which extends in one direction of the width of the hair retaining member 1A, 1B. These hair retaining members 1A, 1B are pivoted by a hinge portion 3 to allow them to open and close. In the closed state, the comb-like hair retaining portions 2, 2 of the hair retaining members 1A, 1B are engaged with each other as shown in FIGS. 1, 2 and 5. In the open state, the comb-like hair retaining portions 2, 2 of the hair retaining members 1A, 1B are disengaged and apart from each other as shown in FIG. 6. The hinge portion 3 includes a shaft 30 and a coil spring 4 wound around the shaft 30. As clearly shown in FIGS. 5 and 6, straight end portions 4A, 4B of the coil spring 4 abut and are pressed against the corresponding inside surface of the hair retaining member 1A, 1B to urge the comb-like hair retaining portions 2, 2 to their closed positions.

Both of the hair retaining members 1A, 1B are molded hard synthetic resin articles and have a similar shape. As shown in FIG. 1, each hair retaining member 1A, 1B includes a comb-like hair retaining portion 2, an outwardly curved ear-shaped lever portion 5 which extends opposite to the comb-like hair retaining portion 2 and is located at the longitudinal central portion of the hair retaining member 1A, 1B, outwardly curved triangular ornamental portions 6, 6 located beside the lever portions 5, 5, an inwardly protruding comb-like covering portion 7 which is branched from the lever portion 5 and a pair of inwardly protruding tongue-like hinge ledges 8, 8 which are located at a portion between the comb-like hair retaining portion 2 and the comb-like covering portion 7.

Figure 3:
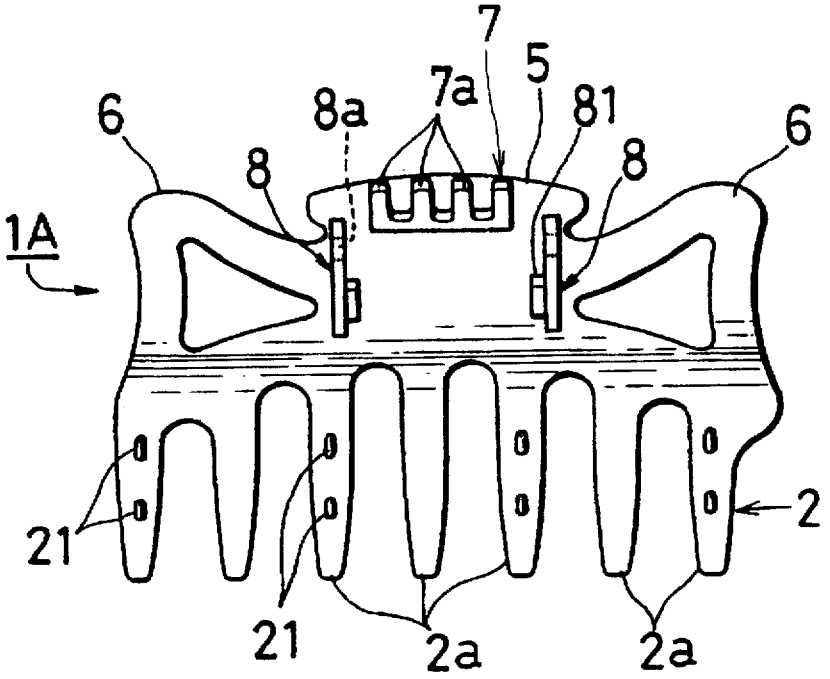
FIG. 3 shows an inner front view of one of the hair retaining members.
Figure 4:
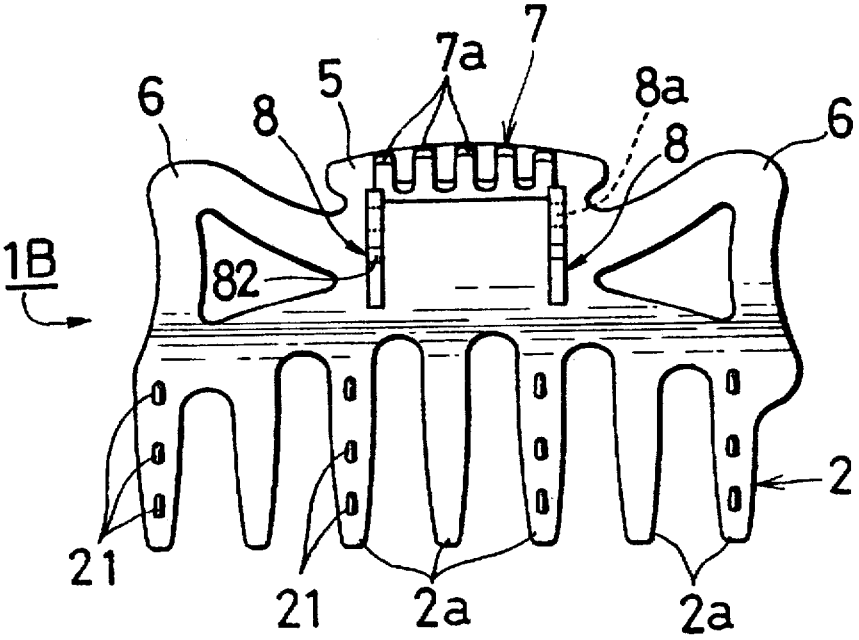
FIG. 4 shows an inner front view of the other hair retaining members.

The comb-like hair retaining portion 2 includes seven inwardly curved flat comb-like tapered teeth 2*a* each having a round end portion. The comb-like teeth 2*a* extend parallel with each other for almost full length of the hair retaining member 1A, 1B. As shown in FIG. 3, one of the hair retaining member 1A has two protrusions 21 on inside surfaces of four comb-like teeth 2*a* at regular intervals along the length thereof. As shown in FIG. 4, the other hair retaining member 1B has three protrusions 21 on inside surfaces of four comb-like teeth 2*a* at regular intervals along the length thereof. Each comb-like covering portion 7, 7 has a plurality of straight slim square comb-like teeth 7*a*. As shown in FIGS. 1 and 2, four comb-like teeth 7*a* are provided on one of the hair retaining member 1A at regular intervals and five comb-like teeth 7*a* are provided on the other hair retaining member 1B at regular intervals. Each comb-like tooth 7*a* has a round end portion.

As shown FIGS. 1 and 2, each hinge ledge 8 of one of the hair retaining member 1A is located adjacent to the outside of the corresponding hinge ledge 8 of the other hair retaining member 1B. Both of the hair retaining members 1A, 1B are pivoted by a shaft 30 whose lateral ends are inserted in the corresponding shaft holes 8*a* provided in the hinge ledges 8.

As shown in FIGS. 3 to 6, protrusions 81, 81 are provided at the insides of the hinge ledges 8, 8 of one of the hair retaining member 1A, and shoulders 82, 82 are formed on the leading edges of the hinge ledges 8, 8 of the other hair retaining member 1B. As shown in FIG. 5, when the hair retaining members 1A, 1B are rotated in the direction of closing the comb-like hair retaining portions 2, 2, i.e. in the direction of the spring force of the coil spring 4, each leading edge of the protrusions 81, 81 abuts against the corresponding shoulder 82 to restrict further rotation of the hair retaining members 1A, 1B. In the state that the hair clip 10 is not in use as shown in FIG. 5, the leading edges of the protrusions 81, 81 abut against the corresponding shoulders 82, 82 such that the comb-like hair retaining portions 2, 2 of the hair retaining members 1A, 1B are engaged with each other, and only the leading edges of the comb-like covering portions 7, 7 of the hair retaining members 1A, 1B are engaged with each other. Under the above-mentioned condition, there exists a gap between adjacent comb-like teeth 2*a*, 2*a* and that the comb-like covering portions 7, 7 are placed such that they form an upwardly bent plane with a vertex at the engaged leading edges of comb-like teeth 7*a*.

By pinching the lever portions 5, 5 of the hair retaining member 1A, 1B against the spring force of the coil spring 4, the comb-like hair retaining portions 2, 2 move toward their open position and the comb-like covering portions 7, 7 further engage as shown in FIG. 6. Thus, the comb-like covering portions 7, 7 take a position parallel with each other as shown by a solid line in FIG. 6, and then take a downwardly bent position as shown by a phantom line in FIG. 6. In each position, the comb-like portions 7, 7 cover the coil spring 4. Because the comb-like covering portions 7, 7 of the hair retaining members 1A, 1B are engaged with each other under the condition when the hair clip is not in use, there will be no possibility of causing abutment of the leading edges of the comb-like covering portions 7, 7 when pinching the lever portions 5, 5, thereby enabling smooth operation. Further, since only the leading edges of the comb-like covering portions 7, 7 are engaged with each other when the hair clip is not in use, the comb-like hair retaining portions 2, 2 can be allowed to widely open by further engaging the comb-like covering portions 7, 7.

The hair clip 10 is used as follows. First, the comb-like hair retaining portions 2, 2 are opened by pinching the lever portions 5, 5 together with one's fingers. Next, the opened comb-like hair retaining portions 2, 2 are placed on bunched hairs 11. Then, by releasing the lever portions 5, 5, the comb-like hair retaining portions 2, 2 will retain the bunched hairs 11. Because the comb-like hair retaining portions 2, 2 are inwardly curved and thus the mutual distance therebetween is large, a large volume of bunched hairs can be retained.

Figure 7:
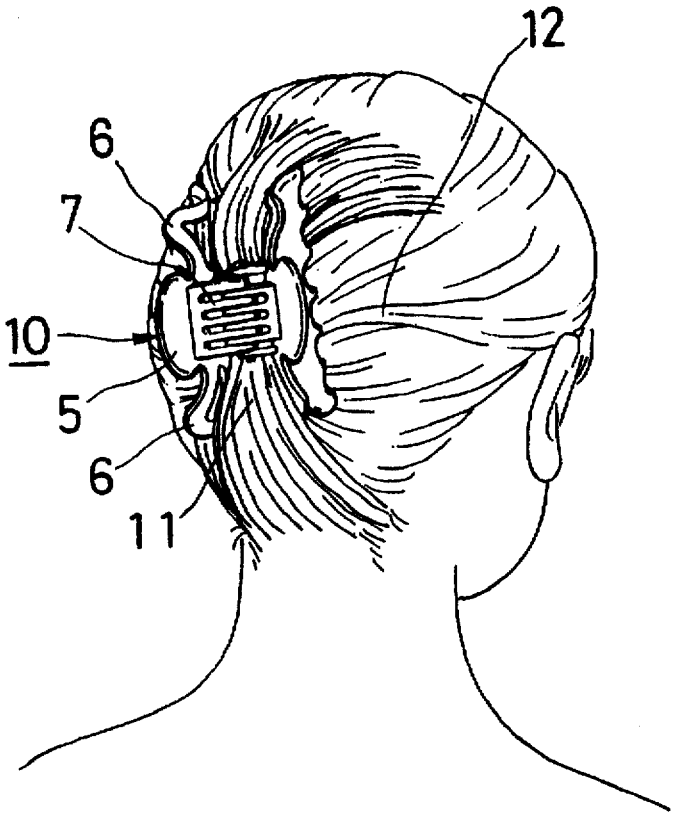
FIG. 7 shows a perspective view of the hair clip in use.

As shown in FIG. 7, when the hair clip is in use, the coil spring 4 of the hinge portion 3 is covered by the deeply engaged comb-like portions 7, 7. Thus, the appearance of the hair clip 10 is good since the coil spring 4 is difficult to see. In addition to the ornamental functions of the ornamental portions 6 and the lever portions 5, the comb-like covering portions 7, 7 function as attractive ornamental portions whose leading edges do not protrude outwardly. Thus, the hair clip 10 will be a good looking ornamental piece for one's hair. Because the comb-like hair retaining portions 2, 2 are inwardly curved, the protrusions 21 formed on the inside of the comb-like teeth 2*a* function as anchors in the bunched hairs and the hairs are retained by and between the engaged comb-like teeth 2*a*, the hair clip 10 can be stably positioned on one's head.

Though the spring force of the coil spring 4 functions to displace the positions of the hair retaining members 1A, 1B in the opposite directions, the strain force is dispersed by the engaged portions of the comb-like covering portions 7, 7 to reduce the strain. Therefore, in the hair clip 10, the twisting force against the hinge ledges 8 of the hair retaining members 1A, 1B can be decreased. As a result, the durability of the hair clip 10 can be enhanced because the hinge ledges 8 are hard to brake.

In the above-mentioned embodiment, the comb-like covering portions 7, 7 are formed to be straight. However, the comb-like covering portions 7, 7 can be of an arc shape around the shaft 30, or any other shape. The locking portion for keeping the hair retaining members 1A, 1B in a certain engaged state when the hair clip 10 is not in use, is not limited to the combination of the protrusions 81, 81 and the shoulders 82, 82 as mentioned above. However, one should avoid providing such a locking portion on a portion other than the hinge ledges 8 because the structure of the hair clip 10 can become complicated.

In the present invention, the number of comb-like teeth 2*a*, the number and/or location of protrusions 21, the number and/or the shielding width of the comb-like teeth 7*a* of the comb-like covering portion 7, the configurations of the lever portions 5 and the ornamental portions 6, and the like, may be changed into various other variations.

As mentioned above, the hair retaining members 1A, 1B include a pair of comb-like hair retaining portions 2, 2 and a pair of inwardly protruding comb-like covering portions 7, 7. The comb-like covering portions 7, 7 are engaged with each other to cover the coil spring 4 when the hair clip is in use. As a result, the hair clip looks good.

Though the spring force of the coil spring 4 functions to displace the positions of the hair retaining members 1A, 1B in the opposite directions, the strain force is dispersed by the engaged the comb-like covering portions 7, 7 to reduce the strain. Because the twisting force against the hinge ledges 8, 8 of the hinge portion 3 is dispersed by the engagement of the comb-like covering portions 7, 7, the hinge portion 3 will become difficult to brake. Therefore, the durability of the hair clip will be enhanced. Since the comb-like covering portions 7, 7 are, at their tip ends, engaged with each other when the hair clip is not in use, the comb-like covering portions 7, 7 can be further engaged to widely open the comb-like hair retaining portion 2, 2 without causing any trouble, even if the amount of bunched hairs is large. Therefore, operation of the hair clip will be enhanced.

The comb-like covering portions 7, 7 have a plurality of straight comb-like teeth 7*a* extending parallel with each other. The comb-like covering portions 7, 7 form an upwardly bent plane with a vertex at the engaged leading edges of the comb-like teeth 7*a* when the comb-like hair retaining portions 2,2 are in their closed positions and also form a flat or downwardly bent plane when the comb-like hair retaining portions 2,2 are in their opened positions. Therefore, the hair clip will look good because the leading edges of the comb-like covering portions 7, 7 never protrude outwardly.

The comb-like hair retaining portions 2, 2 are formed so as to be inwardly curved. Therefore, the hair clip can firmly hold a large amount of hairs.

The comb-like hair retaining portions 2, 2 each has a plurality of protrusions 21 formed on the inside thereof. Therefore, the hair clip can firmly hold hairs.

The comb-like hair retaining portions 2, 2 are formed such that gaps are formed between adjacent comb-like teeth 2*a* when the hair retaining portions 2, 2 are engaged. Therefore, hairs inserted in the gaps will increase the retaining force of the hair clip.

The hinge portion 3 includes a locking portion 81, 81 provided with the hinge ledges 8, 8 for restricting further closing rotation of the comb-like hair retaining portions 1A, 1B. Therefore, the hair retaining members 1A, 1B can be stably kept in their closed positions. Further, the above-mentioned locking means is simple in construction as compared to a locking means which is provided with structure other than the above.

The hair retaining members 1A, 1B each includes a pair of outwardly curved ornamental portions 6, 6 located beside the lever portions 5. Therefore, the hair clip will look good.

The terms and expressions which have been employed herein are used as terms of description and not of limitation, and there is no intent, in the use of such terms and expressions, of excluding any equivalents of the features shown and described or portions thereof, but it should be recognized that various modifications are possible within the scope of the invention claimed.

What is claimed is:

1. A hair clip, comprising:

a pair of hair retaining members of molded hard plastic, said hair retaining members each including a comb-like hair retaining portion extending in one direction of a width of each said hair retaining member, an outwardly curved lever portion extending in the opposite direction to the comb-like retaining portion and an inwardly protruded comb-like covering portion, said hair retaining members are pivoted by a hinge portion, formed between the comb-like hair retaining portion and the comb-like covering portion such that said hair retaining members are swung between a closed position in which the comb-like hair retaining portions are engaged with each other and an opened position in which the comb-like hair retaining portions are disengaged and apart from each other, said hinge portion includes a shaft and a coil spring, the coil spring having end portions which abut and press against a corresponding one of said hair retaining members to urge the comb-like hair retaining portions toward said closed position, said comb-like covering portions are engaged with each other when the comb-like hair retaining portions are in said closed position and are further engaged to cover the coil spring when the lever portions are pinched together against the spring force of the coil spring.

2. The hair clip as recited in claim 1, wherein the comb-like covering portions are, at their tip portion, engaged with each other when the comb-like hair retaining portions are in said closed position.

3. The hair clip as recited in claim 2, wherein the comb-like covering portions have a plurality of straight comb-like teeth extending parallel with each other, and the comb-like covering portions form an upwardly bent plane with a vertex at engaged leading edges of the comb-like teeth when the comb-like hair retaining portions are in said closed position and form a flat or downwardly bent plane when the comb-like hair retaining portions are in said opened position.

4. The hair clip as recited in claim 1, wherein each of said comb-like hair retaining portions is formed to be inwardly curved.

5. The hair clip as recited in claim 1, wherein each of said comb-like hair retaining portions has a plurality of protrusions formed on an inside thereof at regular intervals.

6. The hair clip as recited in claim 1, wherein each of said comb-like hair retaining portions are formed such that gaps are formed between adjacent comb-like teeth when the hair retaining portions are engaged.

7. The hair clip as recited in claim 1, wherein the hinge portion includes a pair of hinge ledges apart form each other and protruding from the insides of the hair retaining members, the corresponding hinge ledges of said hair retaining members being placed adjacent with each other, said shaft whose opposite end portions penetrate the corresponding hinge ledges and a locking portion provided with the hinge ledges for restricting further closing rotation of the comb-like hair retaining portions beyond a certain angle formed therebetween.

8. The hair clip as recited in claim 1, wherein each of said hair retaining members further includes a pair of outwardly curved ornamental portions located beside the lever portions.

* * * * *